US005417918A

United States Patent [19]

Köhler et al.

[11] Patent Number: 5,417,918

[45] Date of Patent: May 23, 1995

[54] AUSTENITIC NICKEL ALLOY

[75] Inventors: Michael Köhler, Iserlohn; Ulrich Heubner, Werdohl, both of Germany

[73] Assignee: Krupp VDM GmbH, Werdohl, Germany

[21] Appl. No.: 12,527

[22] Filed: Feb. 2, 1993

[30] Foreign Application Priority Data

Feb. 6, 1992 [DE] Germany ..... 42 03 328.4

[51] Int. Cl.[6] ..... C22C 19/05

[52] U.S. Cl. ..... 420/443; 420/445; 420/450

[58] Field of Search ..... 420/443, 445, 450; 148/404, 410, 428

[56] References Cited

U.S. PATENT DOCUMENTS

| | | |
|---|---|---|
| 3,969,111 | 7/1976 | Acuncius et al. . |
| 4,043,810 | 8/1977 | Acuncius et al. . |
| 4,080,201 | 3/1978 | Hodge et al. . |
| 4,118,223 | 10/1978 | Acuncius et al. . |
| 4,129,464 | 12/1978 | Matthews et al. . |
| 4,227,925 | 10/1980 | Hosoi et al. . |

FOREIGN PATENT DOCUMENTS

| | | | |
|---|---|---|---|
| 2005371 | 8/1971 | Germany . | |
| 62-158847 | 7/1987 | Japan | C22C 19/05 |
| 62-158848 | 7/1987 | Japan | C22C 19/05 |
| 62-158849 | 7/1987 | Japan | C22C 19/05 |
| 02008337 | 1/1990 | Japan | C22C 19/05 |

*Primary Examiner*—Deborah Yee

*Attorney, Agent, or Firm*—Meltzer, Lippe, Goldstein et al.

[57] ABSTRACT

The invention relates to an austenitic nickel-chromium-molybdenum alloy having high resistance to general corrosion, crevice, pitting and stress crack corrosion and also intercrystalline corrosion, consisting of (in % by weight):

carbon: up to 0.01%
silicon: up to 0.05%
manganese: up to 0.50%
phosphorus: up to 0.020%
sulphur: up to 0.010%
chromium: 14.0 to 18.0%
molybdenum: 14.0 to 18.0%
cobalt: up to 2.0%
tungsten: up to 0.5%
calcium 0.001 to 0.010%
magnesium: 0.001 to 0.020%
aluminium: 0.05 to 0.30%
nitrogen: up to 0.02%
iron: up to 3.0%
copper: up to 0.5%
titanium: up to 0.01% residue nickel and usual impurities due to melting, the sum of the contents (carbon+silicon+titanium) being limited to 0.05% at the most, and the sum of the elements (calcium+magnesium+aluminium) being adjusted within the limits 0.055 to 0.33%.

6 Claims, No Drawings

AUSTENITIC NICKEL ALLOY

The invention relates to an austenitic nickel-chromium-molybdenum alloy having high resistance to general corrosion and crevice, pitting and stress crack corrosion and also intercrystalline corrosion, to its use for structural components used in corrosive media.

BACKGROUND OF THE INVENTION

As a rule, austenitic materials which have satisfactory resistance to general corrosion in both oxidizing and reducing media and also to local corrosion have increased chromium and molybdenum contents. It is known that molybdenum exerts a stronger influence than chromium on resistance to local corrosion. This is shown by the calculation of the action sum W=% Cr+3.3% Mo, a value which serves as a yardstick for determining the resistance to local corrosion to be expected from the composition of the alloy. Frequently the alloying element nitrogen is also included with a factor of 30 in the calculation of the action sum, since a positive influence on resistance to local corrosion is also ascribed to nitrogen. However, higher contents of chromium and molybdenum have an adverse effect on the structural stability of the materials and therefore exert a disadvantageous effect on processing behaviour (hot shaping, welding, etc.). One possible way of improving structural stability is to add nitrogen, but this step is limited by the limited solubility of nitrogen in austenitic materials. Moreover, chromium nitrates may become precipitated and have an adverse effect on resistance to corrosion. Maximum conditions of chromium and molybdenum can be adjusted in the materials only if the nickel content is raised in parallel. Due to the lower carbon solubility in materials based on nickel in comparison with steels, however, the carbon activity increases comparatively more strongly in materials based on nickel. To achieve satisfactory resistance to corrosion, more particularly to reduce liability to intercrystalline corrosion, the prior art requires the known nickel-chromium-molybdenum alloy NiMo16CrTi (Material No. 2.4610 in the Iron and Steel List of the Verein Deutscher Eisenhüttenleute; Publishers Stahleisen mbH, 7th Impression, 1981, corresponding to U.S. Material UNS NO6455) must be stabilized with titanium. An addition of vanadium is also required, for example, as a stabilizing element for the known nickel-based materials NiMo16Cr15 (Material No. 2.4819, corresponding to UNS N10276) and also NiCr21Mo14W (Material No. 2.4602, corresponding to UNS NO6022). The Material NiCr22Mo9Nb (Material No. 2.4856, corresponding to UNS NO6625) is stabilized by an addition of niobium. The amount of added contents of said stabilizing elements normally amounts to 10 to 20 times that of the carbon content, but in the case of the material NiCr22Mo9Nb amounts to 50 to 100 times that content. Stabilization (bonding of the carbon) guarantees the improved resistance to corrosion of welded components without any additional heat treatment.

0.25–0.5% titanium is normally added to the material NiMo16CrTi. According to investigations by R. W. Kirchner and F. G. Hodge, published in "Werkstoffe und Korrosion" (Materials and Corrosion), Vol. 24, 1973, pages 1042–1049), in addition to carbon, titanium also bonds nitrogen via the formation of nitrides. By this effect, titanium is intended to reduce the tendency to sensitization of the material, thus facilitating further processing, for example, welding. However, it is a disadvantage that titanium nitrides produced are present scattered in the structure of the material and more particularly with fairly large dimensions may be locally more strongly concentrated in the form of cloud-shaped accumulations. This then results in corresponding unevennesses of the material which under fairly heavy stressing by corrosion and erosion may take the form of locally uneven detrition. As a result the material loses that smooth-walled surface which is required in the course of many processes and is absolutely necessary to avoid caking e.g., the depositing of gypsum in absorbers for flue gas desulphurization.

SUMMARY OF THE INVENTION

It is an object of the invention to provide a corrosion-resistant and weldable nickel alloy in which locally uneven corrosional detrition is avoided.

This problem is solved by an austenitic nickel-chromium-molybdenum alloy consisting of (in % by weight):

carbon: up to 0.01%
silicon: up to 0.05%
manganese: up to 0.50%
phosphorus: up to 0.020%
sulphur: up to 0.010%
chromium: 14.0 to 18.0%
molybdenum: 14.0 to 18.0%
cobalt: up to 2.0%
tungsten: up to 0.5%
calcium 0.001 to 0.010%
magnesium: 0.001 to 0.020% aluminium: 0.05 to 0.30%
nitrogen: up to 0.02%
iron: up to 3.0%
copper: up to 0.5%
titanium: up to 0.01% residue nickel and usual impurities due to melting, the sum of the contents (carbon+silicon+titanium) being limited to 0.05% at the most, and the sum of the elements (calcium+magnesium+aluminium) being adjusted within the limits 0.055 to 0.33%.

The nickel alloy according to the invention is distinguished by satisfactory weldability and resistance to corrosion. When this nickel alloy is used for articles which are employed in corrosive medium, locally uneven corrosional detrition does not occur.

The nickel alloy according to the invention is therefore particularly suitable as an interior for constructional members of electrolytic treatment plants for the surface treatment of metal strips, more particularly as a material for the making of conveying rollers and flow rollers for electrolytic strip galvanization plants, in which the surface of the rollers must be absolutely smooth in view of the quality of the metal strip to be treated. The use of rollers made of the known material 2.4610 has shown that in metal strip treatment plants, uneven erosion corrosion and also detrition corrosion started on the surface of the rollers, thereby reducing their service life. At the same time, the surface damage to the rollers was transferred to the surfaces of the metal strips to be treated, the result being considerable deterioration in the product quality of, for example, a galvanized metal strip. This fault did not occur when rollers were used which were made from the nickel alloy according to the invention. In use the rollers showed a hitherto unknown service life, which was 5 to 10 times longer than in the case of rollers made from the known alloy 2.4610.

Due to its outstanding surface quality when used in corrosive media, the nickel alloy according to the invention is also suitable as a material for the handling of chemical process media, such as solutions containing iron III chloride and copper II chloride and also hot contaminated mineral acids, formic acid and acetic acid, with satisfactory resistance to wet chlorine gas, hypochlorite and chloride oxide solutions.

The nickel alloy according to the invention is also preferably used as a material for the production of absorber components for the cleaning and desulphurization of flue gases.

The nickel alloy according to the invention is also suitable material for the production of pickling bath tanks and associated components and also of installations for the regeneration of pickling media.

In the nickel alloy according to the invention the general resistance to corrosion is produced by the chromium and molybdenum contents of 14–18%.

The limitation of the sum of the elements (carbon+silicon+titanium) to 0.05% at the most reduces the speed of precipitation of intermetallic phases, for example, of the so-called $\mu$ phase high in molybdenum and chromium. At the same time precipitations of high-molybdenum $M_6C$ carbides and also titanium carbides, titanium nitrides and titanium carbonitrides are suppressed which are observed in the case of the known alloy 2.4610 and during use lead to surface damage in oxidizing and reducing media. To avoid titanium nitrides and titanium carbonitrides, the nitrogen content must not exceed a value of 0.02%. The elements calcium, magnesium and aluminium in the given contents deoxidize and improve the hot shaping properties of the material according to the invention.

Within the maximum limits stated, the elements cobalt, tungsten, manganese, iron and copper do not influence the satisfactory material properties of the nickel alloy according to the invention. During melting, these elements can be introduced via the scrap.

DESCRIPTION OF THE PREFERRED EMBODIMENTS

The nickel alloy according to the invention will now be explained in greater detail with reference to experimental results:

Table 1 shows analyses of 5 works-produced 4.5 ton melts of the alloy according to the invention (alloys A to E) in comparison with an alloy corresponding to Material NiMo16Cr16Ti (Material No. 2.4610).

The charges were produced by melting in an electric arc furnace followed by vacuum deoxidation treatment and also additional remelting in an electric slag remelting installation. Hollow members having an external diameter of 490 mm, an internal diameter of 290 mm and a length of 3200 mm were forged by the usual hot shaping processes. The forgings were then solution annealed and quenched in water. The production of the forgings demonstrated that the hot shapability of the nickel alloy according to the invention would not only be preserved by the technical alloying steps, but even improved, since the addition of aluminium, magnesium and calcium in the stated range indicated clearly that liability to edge crack formation was reduced in comparison with rollers made from Material No. 2.4610. Under the corrosion conditions of electrolytes in strip galvanization plants, rollers produced from the nickel alloy according to the invention showed outstanding resistance to erosive corrosion and also to detrition corrosion and had a 5 to 10 times longer service life than rollers made from the Material 2.4610.

The resistance to corrosion of the nickel alloy according to the invention was tested in comparison with the material NiMo16Cr16Ti (2.4610 and UNS N06455) by boiling for 24 hours in 50% sulphuric acid with an addition of 42 g/l Fe $(SO_4)_3 \times 9\ H_2O$ and also in 10% HCl respectively, the weight loss being determined and converted into a corrosion rate (mm per annum).

By means of the oxidizing effect of iron III sulphate, it was possible to demonstrate precipitations of $M_6C$ carbides and also of $\mu$m phase. In contrast, the reducing test in HCl mainly demonstrated the molybdenum-impoverished zones in the surroundings of the molybdenum-containing precipitations. The results of the corrosion test (cf. Table 2) show that the composition of the austenitic nickel-chromium-molybdenum alloy according to the invention does not cause a deterioration in resistance to corrosion in comparison with the conventional alloy 2.4610, either as regards resistance to intercrystalline corrosion or resistance to general detrition corrosion. These tests show that no precipitations of $M_6C$ carbides or $\mu$ phase occurred with the nickel alloy according to the invention.

To demonstrate resistance to local corrosion, the critical pitting temperature (CPT) and crevice corrosion temperature (CCT) of the alloy A according to the invention were examined in various media.

a) In the "green death" test solution, consisting of 7% $H_2SO_4$, 3% by volume HCl, 1% $CuCl_2$, 1% $FeCl_3 \times 6\ H_2O$, the samples being kept for 24 hours at temperature stages of 5° C., the CPT temperature was 100° C. and the CCT temperature was 90° C.

For TIG-welded samples the CPT temperature was 95° C. The critical temperature is the temperature value at which the first corrosion attacks can be observed.

The measured critical temperatures of the nickel alloy according to the invention mean excellent resistance to pitting and crevice corrosion in the kneaded (heat-shaped) and also in the welded state.

b) During the test in a sulphuric acid solution with the addition of chloride ($H_2SO_4$, pH value=1; 7% chlorine ions) in which the samples were kept for 21 days at 105° C. (boiling), no pitting corrosion and no crevice corrosion attacks were observed.

TABLE 1

Examples of the chemical composition of the alloy according to the invention in comparison with the prior art represented by Material NiMo16Cr16Ti. All details in % by weight.

| Alloy | Cr | Mo | Fe | Ni | Si | Mn | Co | P |
|---|---|---|---|---|---|---|---|---|
| NiMo16Cr16Ti* | 14–18 | 14–17 | <3,0 | Res. | <0,08 | <1,0 | <2,0 | <0,04 |
| + | 15,9 | 15,8 | 0,20 | Res. | −0,03 | 0,51 | 0,03 | 0,005 |
| Charge 2128 | 15,65 | 15,70 | 0,5 | Res. | 0,04 | 0,03 | 0,01 | 0,006 |
| Alloy A | | | | | | | | |
| Charge 2134 | 15,65 | 15,70 | 0,5 | Res. | 0,03 | 0,03 | 0,01 | 0,007 |

TABLE 1-continued

| | | | | | | | | |
|---|---|---|---|---|---|---|---|---|
| Alloy B | | | | | | | | |
| Charge 2141 | 15,90 | 15,75 | 0,33 | Res. | 0,02 | 0,01 | 0,01 | 0,006 |
| Alloy C | | | | | | | | |
| Charge 2142 | 15,50 | 15,70 | 0,32 | Res. | 0,03 | 0,01 | 0,01 | 0,007 |
| Alloy D | | | | | | | | |
| Charge 2143 | 15,90 | 15,75 | 0,33 | Res. | 0,02 | 0,01 | 0,01 | 0,006 |
| Alloy E | | | | | | | | |

| Alloy | S | Cu | Ti | C | Ca | Mg | Al | N |
|---|---|---|---|---|---|---|---|---|
| NiMo16Cr16Ti* | <0,03 | <0,5 | 0,05– | <0,015 | — | — | — | — |
| + | 0,002 | 0,02 | 0,70 | 0,005 | — | — | — | — |
| | | | 0,38 | | | | | |
| Charge 2128 Alloy A | 0,003 | 0,02 | <0,01 | 0,005 | 0,002 | 0,002 | 0,25 | 0,010 |
| Charge 2134 Alloy B | 0,003 | 0,02 | <0,01 | 0,004 | 0,002 | 0,002 | 0,17 | 0,010 |
| Charge 2141 Alloy C | 0,002 | 0,01 | <0,01 | 0,004 | 0,002 | 0,002 | 0,22 | 0,010 |
| Charge 2142 Alloy D | 0,003 | 0,01 | <0,01 | 0,006 | 0,002 | 0,002 | 0,23 | 0,015 |
| Charge 2143 Alloy E | 0,002 | 0,01 | <0,01 | 0,004 | 0,002 | 0,002 | 0,02 | 0,009 |

*German Material No. 2.4610, UNS N06455 (required analysis)
+German Material No. 2.4610, UNS N06455 (actual analysis)
Alloys A to E = according to the invention

TABLE 2

Testing the corrosion behaviour of the alloy according to the invention in comparison with the Material NiMo16Cr16Ti (2.4610)

| | |
|---|---|
| 1. Test for resistance to intercrystalline (IC) corrosion to ASTM G 28 A ($50\%\ H_2SO_4 + 42\ g/l\ Fe_2(SO_4)_3 \times 9\ H_2O$ | |
| Material to Table 1 | Weight loss (corrosion rate) |
| NiMo16Cr16Ti+ | 3.0–3.7 mm per annum |
| alloy A (to invention) | 3.3 mm per annum |
| 2. Test in 10% HCl boiling for 24 hours (detrition corrosion) | |
| Material to Table 1 | Weight loss (corrosion rate) |
| NiMo16Cr16Ti+ | 5.0–5.8 mm per annum |
| alloy A (to invention) | 5.7 mm per annum |

We claim:

1. An austenitic nickel-chromium-molybdenum alloy having high resistance to general corrosion, crevice, pitting and stress crack corrosion and also intercrystalline corrosion, consisting essentially of in % by weight:

carbon: up to 0.01%
silicon: up to 0.05%
manganese: up to 0.50%
phosphorus: up to 0.020%
sulphur: up to 0.010%
chromium: 14.0 to 18.0%
molybdenum: 14.0 to 18.0%
cobalt: up to 2.0%
tungsten: up to 0.5%
calcium: 0.001 to 0.010%
magnesium: 0.001 to 0.020%
aluminum: 0.05 to 0.30%
nitrogen: up to 0.02%
iron: up to 3.0%
copper: up to 0.5%
titanium: up to 0.01%
balance nickel and residual impurities, the sum of the contents of being limited to 0.05% at the most, and the sum of the elements being within the limits 0.055 to 0.33%.

2. A constructional member in an electrolytic treatment plant for the surface treatment of metal strips made from the austenitic nickel-chromium-molybdenum alloy of claim 1.

3. A roller for an electrolytic strip galvanization plant made from the austenitic nickel-chromium-molybdenum alloy of claim 1.

4. A material for handling chemical process media and hot contaminated mineral acids with satisfactory resistance to wet chlorine gas, hypochlorite and chloride oxide solutions made from the austenitic nickel-chromium-molybdenum alloy of claim 1.

5. An absorber component for the purification and desulphurization of flue gases made from the austenitic nickel-chromium-molybdenum alloy of claim 1.

6. A material for pickling bath tanks and associated components, and installations for the regeneration of pickling baths, made from the austenitic nickel chromium molybdenum of claim 1.

* * * * *

UNITED STATES PATENT AND TRADEMARK OFFICE

CERTIFICATE OF CORRECTION

PATENT NO. : 5,417,918
DATED : May 23, 1995
INVENTOR(S) : Kohler et al.

It is certified that error appears in the above-identified patent and that said Letters Patent is hereby corrected as shown below:

Claim 1, at column 6, line 31, after "the contents of" insert,

--carbon + silicon + titanium--.

Claim 1, at column 6, line 32, after "the elements" insert

--calcium + magnesium + aluminum--.

Signed and Sealed this

Fifteenth Day of August, 1995

Bruce Lehman

*Attest:*

BRUCE LEHMAN

*Attesting Officer*

*Commissioner of Patents and Trademarks*